US007782197B2

(12) United States Patent
Lang et al.

(10) Patent No.: US 7,782,197 B2
(45) Date of Patent: Aug. 24, 2010

(54) SYSTEMS AND METHODS OF DETECTION USING FIRE MODELING

(75) Inventors: Scott R. Lang, Geneva, IL (US); Andrew G. Berezowski, Wallingford, CT (US)

(73) Assignee: Honeywell International Inc., Morristown, NJ (US)

( * ) Notice: Subject to any disclaimer, the term of this patent is extended or adjusted under 35 U.S.C. 154(b) by 487 days.

(21) Appl. No.: 11/940,792

(22) Filed: Nov. 15, 2007

(65) Prior Publication Data

US 2009/0128327 A1 May 21, 2009

(51) Int. Cl.
*G08B 13/00* (2006.01)

(52) U.S. Cl. ..... 340/541; 340/628; 340/584

(58) Field of Classification Search ..... 340/540, 340/541, 584, 628, 630, 286.05
See application file for complete search history.

(56) References Cited

U.S. PATENT DOCUMENTS 4,796,205 A * 1/1989 Ishii et al. ..... 340/506
5,557,262 A * 9/1996 Tice ..... 340/587
5,726,633 A * 3/1998 Wiemeyer ..... 340/587
5,734,335 A * 3/1998 Brogi et al. ..... 340/870.05
5,818,326 A * 10/1998 Winterble et al. ..... 340/286.05
6,556,981 B2 * 4/2003 Pedersen et al. ..... 706/44
7,286,050 B2 * 10/2007 Faltesek ..... 340/524
7,327,247 B2 * 2/2008 Tice ..... 340/511
7,551,096 B2 * 6/2009 Tice ..... 340/630
7,690,837 B2 * 4/2010 Ahlers et al. ..... 374/8
2008/0180258 A1 * 7/2008 Lang et al. ..... 340/584

* cited by examiner

*Primary Examiner*—Eric M Blount
(74) *Attorney, Agent, or Firm*—Husch Blackwell Sanders Welsh & Katz

(57) ABSTRACT

A system for adjusting parameters of ambient condition detectors in a regional monitoring system is coupled to or includes fire modeling processing. Based on outputs from the processing, selected parameters of respective detectors can be adjusted to shorten detector time to alarm. As a fire condition develops, different detectors can be adjusted dynamically and in real-time.

17 Claims, 4 Drawing Sheets

SYSTEMS AND METHODS OF DETECTION USING FIRE MODELING

FIELD

The invention pertains to systems and methods of fire detection. More particularly, the invention pertains to such systems and methods which respond to predicted fire behavior to adjust selected detectors to more immediately respond to a potential or developing condition.

BACKGROUND

Various types of ambient condition regional monitoring systems are known. In connection with fire detection, such systems usually include a control unit or panel which is coupled to a plurality of ambient condition detectors, fire, smoke, gas or the like to ascertain the presence of a developing or actual fire. Audible and visual alarm indicating output devices can be coupled to the system and activated as needed in the presence of an alarm.

In such fire detection systems, various techniques are used to prevent false alarms due to nuisance conditions. These techniques generally have the effect of slowing the response of the smoke detector. Typically, a design trade-off is made so that the response to real fires and nuisances is optimized.

Also some fire detection systems include fire modeling systems. One such system has been disclosed in U.S. Pat. No. 7,286,050 B2 entitled "Fire Location Detection and Estimation of Fire Spread Through Image Processing Based Analysis of Detector Activation" issued Oct. 23, 2007. The '050 patent is assigned to the assignee hereof and incorporated by reference. The system of the '050 patent establishes a fire profile based on a time sequence of alarming detectors and provides both direction and velocity information to the alarm system control unit. Another fire modeling system has been disclosed in U.S. patent application Ser. No. 11/618,339 entitled Systems and Methods to Predict Fire and Smoke Propagation filed Dec. 29, 2006. The '339 application is assigned to the assignee hereof and incorporated by reference. Other fire modeling systems are also known.

It would be desirable to be able to use fire profile or modeling information in making decisions as to other portions of the monitoring system, or associated detectors that may not be exhibiting an alarm condition as yet.

BRIEF DESCRIPTION OF THE DRAWINGS

FIGS. 3-1, -2, illustrate a developing fire condition in a region R;

FIGS. 3-3, -4 illustrate a potential fire condition in the region R; and FIG. 4 is a flow diagram of a method in accordance with the invention.

DETAILED DESCRIPTION

Figure 1:
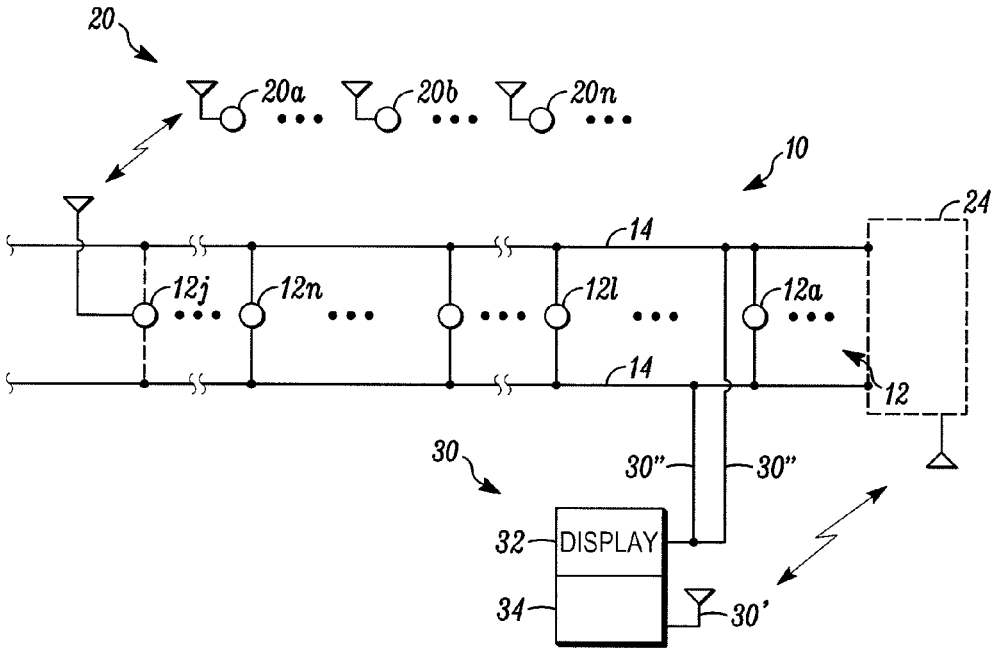
FIG. 1 is a block diagram of a monitoring system in accordance with the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the present invention optimize the detection processing in a fire detector or control panel by using the output of a fire model as an input. If the model predicts that certain conditions will be present at a certain location, operational parameters for the detectors in that area can be adjusted for those predicted conditions. Some of the parameters that can be changed are: sensitivity, delays, smoothing, filtering, alarm verification, etc.

Embodiments of the invention can be coupled to a real-time fire modeling process being executed by a respective monitoring system. In one embodiment, if a fire breaks out in a building and is detected, the fire modeling program would run and make predictions of the potential spread of the fire. In accordance with the present invention, smoke or fire detectors that are in the predicted path of the fire could be adjusted to exhibit shortened response times by altering their detection parameters. Since the likelihood of a real fire is greatly increased and the probability of a nuisance condition is decreased, the fact that such adjusted detectors would be more sensitive, for example, would in all probability not create undesirable nuisance alarms. Detection parameters could similarly be changed before any fire is detected based on real-time modeling of a building's potential fire hazards. As those hazards move or change, the model could continue to be executed, and the detector's parameters continually and dynamically changed in response thereto.

In one embodiment the sensitivity of all detectors on the system could be increased once any detector has exhibited a verified alarm, effectively putting the system "on alert." In another embodiment those detectors in a predicted fire path could be adjusted to be extremely sensitive while those further from the path could be adjust to be more sensitive than normal but less so than those expected to be in the direct path of the fire.

Aspects of a method that embodies the invention can include one or more of the following.

Building parameters such as temperature, humidity, or air velocity can be automatically fed into the fire modeling system from the building control system. Other necessary parameters can be manually or automatically input into the model;

Sensitivity, alarm verification, or day/night settings can be adjusted based on outputs of the model;

Fire alarm control panels often include processing that filters or "smoothes" the signals from fire detectors. These filtering parameters could be changed based on the results from the fire modeling program;

If the model shows the progression of a predicted fire scenario in one particular direction, the fire detectors in that area could be sensitized;

If hazardous materials are moved into an area, the model can be executed and the appropriate detectors sensitized;

Heat detectors' pre-established respective temperature set points could be changed based on the processing results;

The model could alert the user that a different type of detector (smoke vs. heat) may be required in one area based on the model results;

The building or area floor plan could be input into the modeling program manually or automatically.

Potential hazards could be input into the modeling program. These hazards could be in a library that the user could access. Some potential hazards might be stacks of pallets, stored flammable chemicals, gas cylinders, batteries, etc.

The user could select possible fire scenarios, e.g., burning chair, electrical overload, wastebasket fire, etc. There could be a library of possible fires. The items in the library could vary in both material and size. Some scenarios could involve fires in multiple locations.

In addition to predictive improvements that might be obtained by sensitizing initiating devices in the predicted path of fire and smoke, it might be desirable to monitor the smoke density as accurately as possible and for as long as possible in order to confirm/adjust predicted model parameters and understand when tenability limits are being approached. To achieve this, detectors that have reached the alarm level due to smoke or heat can be sent commands from the alarm system control unit, or, panel (or are self-adjusted) to greatly reduce their sensitivity (by an order of magnitude or by as much as is technically achievable for the type of detector employed). This enables monitoring of actual conditions long after ordinary detectors have reached saturation limits. The scale of sensitivity may be predetermined by the respective detector and indicated in a transmission to the panel. The scale or mode of sensitivity may be transmitted to the respective detector by the panel.

Figure 2:
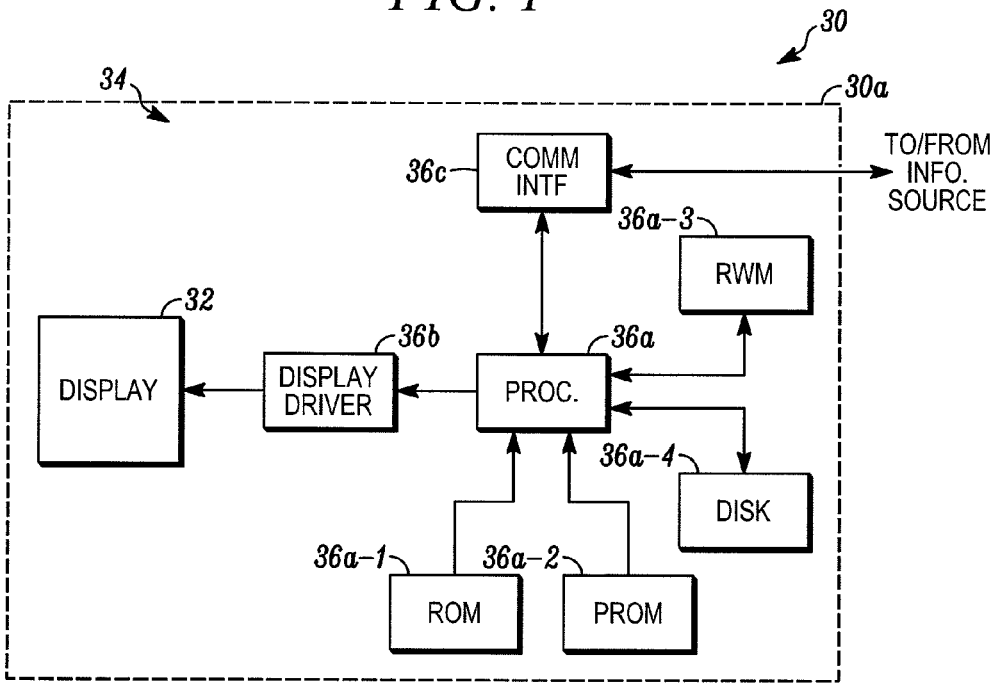
FIG. 2 is a block diagram of a control unit for the system of FIG. 1.

FIGS. 1, 2 illustrate details of a system 10 in accordance with the invention. In FIG. 1, a system 10 incorporates a plurality of electrical units 12, including 12*a*, 12*b* . . . 12*n*, all of which can be in bi-directional communication via a communications link 14. The link 14 could be implemented as a hard-wired electrical or optical cable. Alternately, as illustrated in connection with the system 10, a plurality 20 of electrical units 20*a*, 20*b* . . . 20*n* could communicate with one another wirelessly.

Wireless communication could be implemented using RF signals or the like without limitation. The members of the plurality 20 could be in wireless communication with one or more members, such as the member 12*j* of the plurality 12. It will be understood that the exact details of communication between electrical units, members of the plurality 12 and 20, is not a limitation of the present invention.

If desired, the system 10 could include a common control element 24, illustrated in phantom, to provide sequencing, power and supervision for the electrical units in the pluralities 12 and 20.

The members of the pluralities 12 and 20 could include ambient condition detectors as well as audible or visible output devices without limitation. Types of detectors could include fire detectors, such as flame, thermal or smoke detectors. Other types of detectors could include motion detectors, position detectors, flow detectors, velocity detectors, and the like, all without limitation.

Coupled to the system 10, either via hardwiring or wirelessly is a display device 30. It will be understood that the device 30 could be implemented as a portion of the control element 24 if desired. Alternately, the device 30 could be a separate unit from the control element 24. Device 30 could also be a portable unit which is in wireless communication with the system 10.

Device 30 includes a display unit 32 and a processing section 34. A port or ports can be provided on device 30 to connect it to system 10 wirelessly, via antenna 30' or hard-wired with cable 30".

With reference to FIG. 2, a case or housing 30*a* contains, carries, or supports the display device 32 and the processing element 34. The processing element 34 in turn includes a programmable processor 36*a* which is in communication with local read-only member 36*a*-1 and/or local programmable read-only memory 36*a*-2 and/or local read/write memory 36*a*-3. Control programs and/or fire modeling programs can be stored in computer readable form in one or more storage units such as 36*a*-1, -2, -3 as well as one or more magnetic or optical disk drives 36*a*-4 coupled to programmable processor 36*a*.

The associated local memory incorporates executable control instructions whereby the processor 36*a* carries out an analysis and display function as described subsequently. Additionally, programs or information as described subsequently, can be stored, encoded in a computer readable medium in the device 30 on a real-time basis, or downloaded from the system 10 for display.

The processor element 34 also includes display driver circuitry 36*b* and a bi-directional communications interface 36*c* intended to be used with antenna 30' for wireless communication or to be coupled via cable 30" to communication link 14.

It will be understood that the device 30 could be permanently attached to the system 10 and provide displays only associated therewith. Alternately, the device 30 could be a stand-alone device in wireless communication with a variety of ambient condition sensing systems without limitation.

Figures 1, 3:
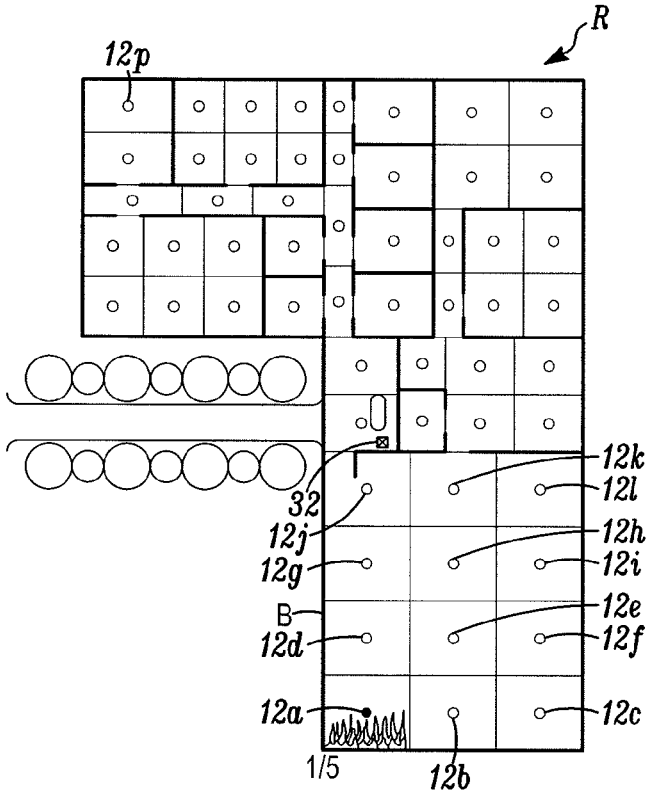
Figures 2, 3:
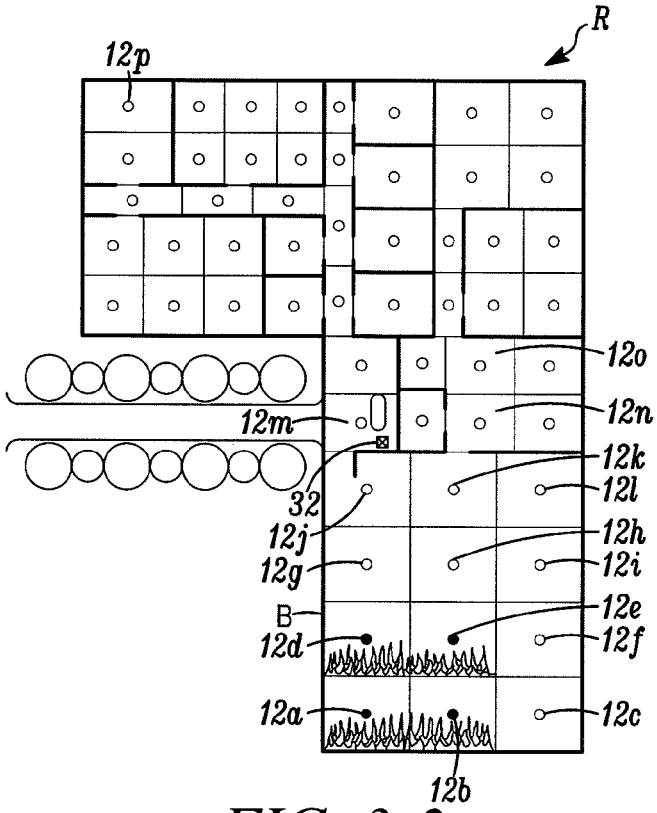
Figure 3:
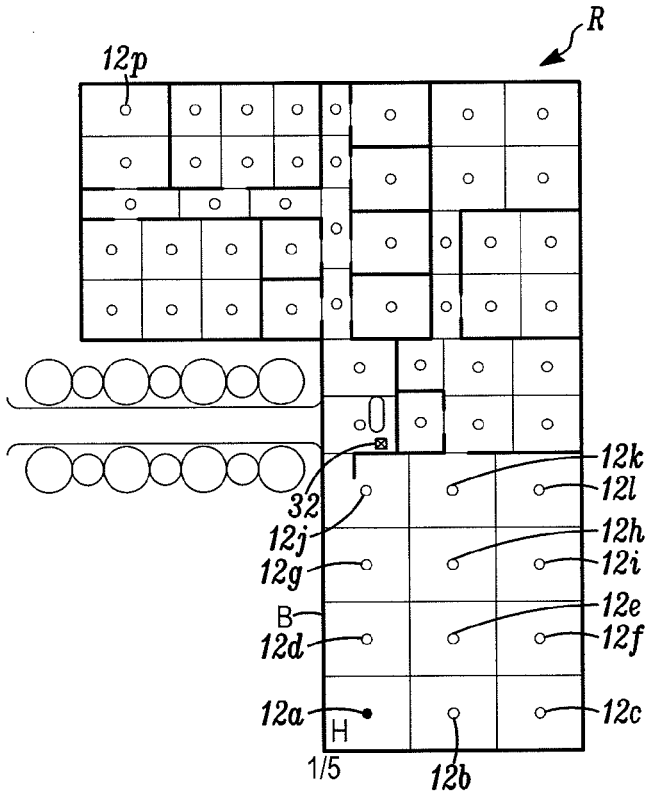

As illustrated in FIG. 3-1, -2, detectors 12*a* . . . 12*p* are located throughout a region R. Region R could represent one floor of a multi-floor building B being monitored. For exemplary purposes only, FIGS. 3-1 and 3-2 illustrate a developing fire condition in the region R.

The system 10 includes the members of the plurality 12 which might be implemented as smoke detectors. The detectors 12 are illustrated installed throughout the region R. When so configured, the system 10 would function as a fire alarm system. In the event that the members of the plurality 12 included other types of sensors such as position or motion or motion sensors, the system 10 could also provide an intrusion monitoring function. It will also be understood that the members of the plurality 12 could each incorporate multiple sensors, for example, smoke, gas, thermal, without limitation and without departing from the spirit and scope of the present invention.

Those of skill in the art will understand that control unit 30 can via "wireless medium 30' or wired medium 30" establish a set of operations parameters for members of the plurality 12. Types of parameters were as noted above, all without limitation. Further, processor 36*a* can execute one or more fire modeling programs as described subsequently.

In FIG. 3-1, a detector 12*a* has gone into alarm indicative of the presence of a local fire condition. Subsequently, FIG. 3-2, the fire has spread and detectors 12*a*, *b*, *d* and *e* have all gone into alarm. A fire modeling program, executed at processor 36*a* can as explained below, provide inputs to a detector parameter control program also executable by processor 36*a*.

Figures 3, 4:
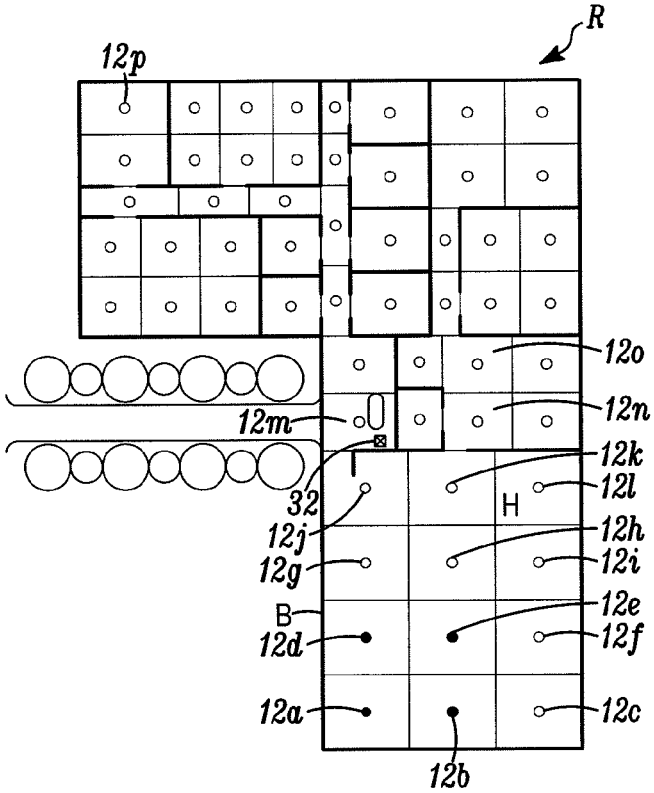
Figure 4:
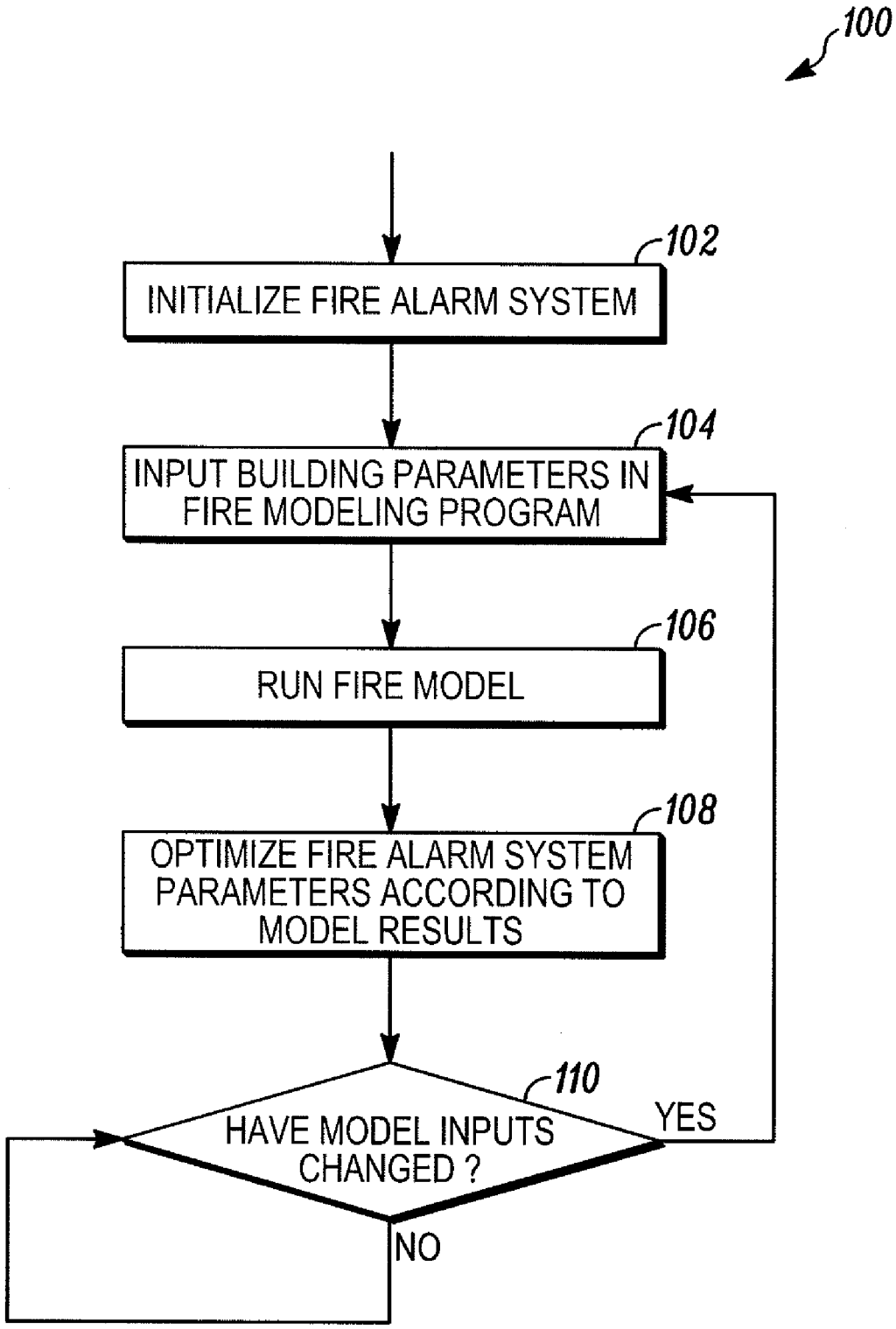

In FIG. 3-3, a potential hazard has been identified near detector 12*a*. The modeling program may predict a spread to adjacent rooms. So, detectors 12*a*, 12*b*, 12*c*, and 12*d* may have their sensitivity increased. If the model indicates that the fire will only spread in one direction due to air flow or physical construction, only those detectors' sensitivities need be changed. In FIG. 3-4, the potential hazard has moved to the vicinity of detector 12*l*, and, the fire modeling program must be executed again. If the model indicates fire spread to nearby rooms, the detectors therein should have their sensitivities increased and previously adjusted detectors should be returned to normal sensitivity.

FIG. 4 is a flow diagram of a method 100 in accordance with the invention. The fire alarm monitoring system, for example a system as system 10, is initialized as at 102. Building parameters are input to a respective fire modeling and predicting program as at 104.

The fire predicting program can be executed by the system 10, as at 106. Based on results of executing the predicting program, various parameters of the system can be optimized as at 108. For example, the parameters of various members of the plurality of detectors 12 can be adjusted.

Relative to FIG. 3-2, Sensitivity parameters of detectors 12*c*, 12*f*, 12*g*, 12*h*, 12*j*, 12*k* and 12*l* could be adjusted so that those detectors will respond most rapidly to any fire indications. Sensitivity parameters of other detectors, such as 12*m*, 12*n* and 12*o* could also be adjusted so that those respond rapidly but perhaps not as rapidly as will the group of 12*c*, 12*f* . . . 12*l*. Those of skill will understand that other parameters can be adjusted in response to results of executing the model at 106, without departing from the spirit and scope of the invention.

Results of executing the model can be monitored on an on-going basis in real time, at 110. Where those results have changed, the process can be re-executed.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A method of adjusting a fire alarm system comprising:
- establishing a plurality of ambient condition sensing locations in a selected region;
- providing a respective ambient condition detector at each of the locations;
- setting an operational state of each of the ambient condition detectors;
- establishing the existence of a potential alarm condition;
- responsive to establishing the existence of the potential alarm condition;
- obtaining pre-stored parameters of the region and automatically creating a prediction as to how the alarm condition will develop in the region; and
- responsive to the prediction, altering the operational state of at least some of the detectors.

2. A method as in claim 1 where altering includes altering detector parameters selected from a class which includes at least detector sensitivity, detector delays, detector signal smoothing, or filtering.

3. A method as in claim 1 where setting the operative state of some of the ambient condition detectors includes setting a sensitivity parameter of the respective detector to a first value.

4. A method as in claim 3 which includes altering the operative state of at least some of the detectors by changing the sensitivity parameters of respective detectors from the respective first values to second, different values.

5. A method as in claim 4 where changing the sensitivity to the second value shortens time to alarm of the respective detector.

6. A method as in claim 1 where establishing the existence of a potential alarm condition includes at least one of, sensing a predetermined output from a respective detector, or, executing a fire modeling program.

7. A system comprising:
- a plurality of ambient condition detectors;
- a control unit coupled to the detectors, the control unit including circuitry for establishing at least one parameter value of each of a plurality of the detectors;
- modeling circuitry, coupled to the control unit, the modeling circuitry responds to at least one of a detector output, or a manual input to predict at least a travel path of one of a potential, or, developing alarm condition and where the control unit, responsive to the predicted travel path alters the at least one parameter value of selected detectors along the predicted travel path.

8. A system as in claim 7 where the control unit includes a programmable processor and associated executable control software, encoded on a computer readable medium, response to outputs from members of the plurality of detectors.

9. A system as in claim 8 where the control software, when executed, establishes the at least one parameter value for members of the plurality of detectors.

10. A system as in claim 9 where the control software alters the at least one parameter value of selected detectors along the predicted travel path.

11. A system as in claim 7 where members of the plurality of detectors are selected from a class which includes at least thermal detectors, smoke detectors, fire detectors, gas detectors and intrusion detectors.

12. A system as in claim 10 where members of the plurality of detectors are selected from a class which includes at least thermal detectors, smoke detectors, fire detectors, gas detectors and intrusion detectors.

13. A system as in claim 7 which includes storage for computer executable fire modeling software.

14. A system as in claim 12 where the modeling circuitry includes storage circuitry for computer executable fire modeling software.

15. A system as in claim 14 where the fire modeling software is encoded in computer readable form in at least one of a magnetic storage device, or, an optical storage device.

16. Software encoded in a computer readable medium which when executed by a programmable processor comprises:
- obtaining a set of building parameters for a respective region;
- establishing at least one of, the potential for a fire condition, or, the presence of a developing fire condition in at least part of the respective region;
- making a prediction of behavior of the developing condition; and
- adjusting a set of parameters of a respective regional monitoring system in response to the predicted behavior and awaiting additional information as to the developing condition.

17. Software as in claim 16 where adjusting includes at least one of, adjusting a set of sensitivity parameters of members of a plurality of ambient condition detectors, or, adjusting a set of filter-related parameters of members of a plurality of ambient condition detectors and, using outputs therefrom in predicting the behavior of the developing condition.

* * * * *